US011772928B2

(12) United States Patent
Heymann et al.

(10) Patent No.: US 11,772,928 B2
(45) Date of Patent: Oct. 3, 2023

(54) DEVICE AND METHOD FOR WINDING A THREAD

(71) Applicant: STC SPINNZWIRN GMBH, Chemnitz (DE)

(72) Inventors: Frank Heymann, Chemnitz (DE); Michael Hannusch, Chemnitz (DE)

(73) Assignee: STC Spinnzwirn GmbH, Chemnitz (DE)

( * ) Notice: Subject to any disclaimer, the term of this patent is extended or adjusted under 35 U.S.C. 154(b) by 218 days.

(21) Appl. No.: 17/432,674

(22) PCT Filed: Sep. 4, 2020

(86) PCT No.: PCT/IB2020/058242
§ 371 (c)(1),
(2) Date: Aug. 20, 2021

(87) PCT Pub. No.: WO2021/090082
PCT Pub. Date: May 14, 2021

(65) Prior Publication Data

US 2022/0169478 A1 Jun. 2, 2022

(30) Foreign Application Priority Data

Nov. 6, 2019 (DE) ..... 10 2019 129 966

(51) Int. Cl.
*B65H 65/00* (2006.01)
*B65H 54/553* (2006.01)
*B65H 54/34* (2006.01)

(52) U.S. Cl.
CPC ..... *B65H 65/00* (2013.01); *B65H 54/343* (2013.01); *B65H 54/553* (2013.01); *B65H 2701/31* (2013.01)

(58) Field of Classification Search
CPC .... B65H 54/343; B65H 54/553; B65H 65/00; B65H 2701/31
See application file for complete search history.

(56) References Cited

U.S. PATENT DOCUMENTS 4,102,507 A 7/1978 Hoffmann et al.
5,263,656 A 11/1993 Raasch

FOREIGN PATENT DOCUMENTS

CH 596074 A5 2/1978
DE 1125107 A1 2/1993
(Continued)

OTHER PUBLICATIONS

Machine Translation of DE 101 39 015 A1, Feb. 20, 2003. (Year: 2003).*

*Primary Examiner* — William E Dondero
(74) *Attorney, Agent, or Firm* — Laurence A. Greenberg; Werner H. Stemer; Ralph E. Locher

(57) ABSTRACT

A device and a method wind a thread on a winding machine. The winding machine has a spool sleeve and a spool holder, which has two oppositely disposed centering plates, having an adjustable axial distance relative to each other, for tensioning the spool sleeve. The centering plates each have a centering cone which engages in an open spool sleeve end, and an arrester hook for arresting the thread being provided in one of the centering plates. The arrester hook is oriented in the circumferential direction of the centering plate, and the centering plate having the arrester hook contains an outer cone which overlaps the outer diameter of the spool sleeve end. An inside of the arrester hook is formed by a nose-like recess provided in the outer cone.

10 Claims, 3 Drawing Sheets

A

B

(56) References Cited

FOREIGN PATENT DOCUMENTS

| | | | |
|---|---|---|---|
| DE | 4334813 | A1 | 5/1994 |
| DE | 19637298 | A1 | 3/1998 |
| DE | 10139015 | A1 | 3/2003 |
| DE | 3943794 | B4 | 11/2004 |
| DE | 102005049166 | A1 | 4/2006 |
| DE | 102016004563 | A1 | 10/2017 |
| EP | 1129975 | A2 | 9/2001 |
| JP | 2004196470 | A | 7/2004 |

* cited by examiner

DEVICE AND METHOD FOR WINDING A THREAD

BACKGROUND OF THE INVENTION

Field of the Invention

The present invention relates to a device for winding a thread on a winding machine with at least one bobbin tube and a bobbin holder, which comprises two opposing centering disks, adjustable in their axial distance from one another, for tensioning the bobbin tube, wherein the centering disks each comprise a centering cone that engages in an open bobbin tube end and wherein a fixed hook for catching the thread, which is aligned in the circumferential direction of this centering disk, is provided. The invention also relates to a method for winding a thread on a winding machine onto a bobbin tube, which is tensioned by two opposing centering disks of a bobbin holder that are adjustable in their axial distance from one another, the centering disks each having a centering cone, which engages in an open end of the bobbin tube, wherein the thread is caught with a fixed hook, which is provided on one of the centering disks and aligned in the circumferential direction of this centering disk.

A device and a method of this type are known, for example, from the prior art document DE 10 2016 004 563 A1. In order to wind a thread onto a new bobbin tube, the device described comprises a groove with a catch projection for catching the thread and an auxiliary device with a suction device for guiding the thread, when the bobbin is changed, on the circumference of a clamping disk that is used to tension the bobbin tube. After the thread that was previously fed onto the old bobbin tube has been cut, the resulting loose thread end is picked up by the suction device and removed. After the old, wound bobbin on the bobbin holder has been replaced by a new bobbin tube, the thread is picked up by a thread guide. When the clamping disk is rotated, a thread portion of the incoming thread located on the edge of the clamping disk falls into the groove and is thus caught by the catch projection. The clamping disk comprises a clamping and cutting mechanism, which is not described in detail, so that the incoming thread can be fixed in place and wound onto the bobbin tube. The thread can be automatically picked up by a traversing thread guide, whereupon a new bobbin travel begins.

Prior art offers various options for clamping and fixing a thread on a new bobbin tube and/or a clamping or centering disk tensioning this bobbin tube.

Probably the best known of these options is to provide a catching slot or a catching notch that extends over at least part of the circumference of the bobbin tube in the outer surface of the bobbin tube. Since the thread and the bobbin tube have the same direction of movement when the thread is caught in a catching slot, the problem is that the thread does not stay in the catching slot and leaves the same again in the radial direction. To solve this problem, the catching slot in the prior art document DE 39 43 794 B4 is composed of a drop-in piece and a clamping piece, wherein the thread is to be held in the clamping piece in a force-fitting and form-fitting manner. This approach did not prove successful, however, because on the one hand the thread is not reliably received in the catching slot, and on the other hand the bobbin tubes have to be specially equipped due to the catching slot to be formed, which entails additional costs.

Another option is to hold the thread such that it is carried around the hook by friction. This possibility was also discarded because the thread does not reliably remain on the hook for lack of adherence or because soiling occurs on it over the course of time, for example due to thread remnants caused by thread breakage.

Prior art also proposes a movable hook which holds the thread in place with the help of centrifugal force, wherein the clamping is released when the centering disk comes to a standstill. Here, too, the problem is that the hook can lose its functionality over time. In addition, it is technically complicated to introduce moving parts into the design.

The same applies to the proposal to clamp the thread between an immovable hook and a movable clamping ring, wherein the clamping is released when a chuck holding the centering disk is released.

In the prior art document DE 196 37 298 A1, an annular thread catching body made of an elastic material with at least one catch projection is arranged on an end face of a centering disk of a winding device facing a bobbin. Due to the elasticity of the material, the catch projection that has gripped the thread can move away regardless of the thread thickness and the nature of the thread so that thread damage can be excluded. The side facing away from the tip of the catch projection is secured against lifting off from the end face of the centering disk. This prevents the caught thread from slipping between the thread catching body and the centering disk.

The prior art document DE 43 34 813 A1 discloses a winding device for winding a continuously fed thread with two centering disks, between which a bobbin tube is clamped and of which one comprises a catch groove for the thread. On the side of the centering disk with the catch groove facing the bobbin tube, an annular collar extending over the edge of the tube is provided.

The prior art document DE 101 39 015 A1 describes a bobbin disk, produced for example by deep drawing or bending, for receiving a bobbin tube. Due to the mechanical deformation that occurs during the manufacturing of the bobbin disk, the disk solidifies and can be designed with both a small wall thickness and low weight. The bobbin disk comprises at least one thread catch projection which is formed by a recess in the edge region of the bobbin disk.

The prior art document DE 10 2005 049 166 A1 discloses a winding device for winding a continuously fed thread with a bobbin holder, which holds a bobbin tube between two rotatably mounted clamping disks. One of the clamping disks comprises a catching device for applying and catching a thread at the start of the winding process. To avoid imbalances on the clamping disk, a compensating mass is provided which compensates for the mass of the catching device and which is formed in a circumferential position that is offset from the catching device.

If the thread is clamped in the centering disk or in the chuck of the centering disk, the thread must be actively pulled out of this clamping when the bobbin winding is completed because otherwise there is a risk that the wound bobbin will not unroll evenly or that it will be inclined because it will catch on the still attached thread.

SUMMARY OF THE INVENTION

It is therefore the object of the present invention to provide a device and a method of the type specified at the outset, which make a reliable thread clamping possible without great design effort, when the thread is caught during an automatic bobbin change and without having to fear a functional impairment due to soiling that is caused for example by adhering thread remnants due to thread breakage.

This object is achieved with the features of the independent claims. Advantageous developments of the invention are the subject matter of the subclaims.

The object is achieved on the one hand by a device for winding a thread on a winding machine with at least one bobbin tube and a bobbin holder comprising two opposing centering disks, adjustable in their axial distance from one another, for tensioning the bobbin tube, wherein the centering disks each have one centering cone that engages in an open bobbin tube end, and wherein, on one of the centering disks, a fixed hook for catching the thread aligned in the circumferential direction of this centering disk is provided, wherein the centering disk with the hook comprises an outer cone that overlaps the outer diameter of the bobbin tube end, an inner side of the hook is formed by at least one nose-shaped recess provided in the outer cone and, when the bobbin tube is clamped on the device, an edge between the outer side and the end face of the bobbin tube end rests on an inner wall of the outer cone.

The present invention takes a completely different approach than the prior art for clamping the thread when catching the thread. In the device according to the invention, the thread is caught at the point called thread clamping point here, where the edge or corner that is present between the outer side and the end face of the bobbin tube end rests against the inclined inwardly extending inner wall of the outer cone. The thread clamping point is the end of an air gap, the extent of which is reduced in the circumferential direction of the centering disk having the hook and finally approaches zero at the thread clamping point so that even threads with a very small diameter can easily be securely clamped at the thread clamping point.

The thread to be wound on the new bobbin, which was previously caught by the hook, is clamped, i.e., fixed, at the thread clamping point.

The bobbin tube is cylindrical, comprises an outer side and two opposite end face edges and is preferably made of cardboard or plastic. If the bobbin tube is made of such a relatively soft material, the edge or corner formed between the outer side and the end face presses with a certain surface against the inner wall of the outer cone so that a reliable thread clamping is ensured in this pressed region. The bobbin tube can alternatively be made of any other material suitable for a thread to be wound on, such as wood or a natural material. However, it can also be made of metal in the present invention.

In the present invention, the bobbin tube need not have a thread-receiving slot or a thread-receiving groove.

The centering cone, in cooperation with the outer cone and the tension forces acting laterally on the two centering disks, makes it possible for the bobbin tube to be wound and to be fixed in place, wherein the centering cone makes it possible for the bobbin tube to be centered and the outer cone, in particular, makes it possible for the thread to be clamped.

In the present invention, the clamping of the thread fixed at the thread clamping point is advantageously released immediately as soon as the wound bobbin tube is released from the bobbin holder, i.e., as soon as the two centering disks move away from each other since the thread clamping point is solely formed by the interaction of the bobbin tube and the centering disk comprising the hook.

The hook can be bent slightly outwards at its tip, i.e., such that it points away from a center point of the centering disk in order to make it easier to catch the thread.

The thread clamping gap leading to the thread clamping point begins directly behind the hook. The thread picked up by the hook is thus guided directly to the thread clamping point.

In a preferred embodiment of the device according to the invention, the inner wall of the outer cone of the centering disk comprising the hook is formed by at least three annular segments spaced from one another by a groove, with one of these annular segments transitioning directly into the recess, i.e., directly adjoining the hook.

If the bobbin tube is clamped on the device, the bobbin tube rests against the at least three annular segments with the edge or corner present between its outer side and its end face. The grooves located between the annular segments provide some leeway for any manufacturing tolerances that the bobbin tube may have. It is possible, for example, that the bobbin tube does not have a perfectly round cross section.

Even if this leads to underdetermination or overdetermination, only two or more than three annular segments can generally be present with the thickness, length and number of the respective annular segments being selected such that the bobbin tube is securely supported in each case. Centering disks with exactly three annular segments ensure a certain support of bobbin tubes, which can have production-related irregularities on their circumferential and/or inner wall.

An expedient embodiment of the device according to the invention comprises a traversing thread guide that is located in the thread running direction in front of the bobbin tube, parallel to the axis of rotation of the bobbin tube and that can move back and forth and stop in a feed position, a thread suction device located in the thread running direction behind the bobbin tube and oriented transversely to the axis of rotation of the bobbin tube and an application lever, which can be moved transversely to a thread run between the traversing thread guide and the thread suction device in a position in the thread running direction behind the bobbin tube at the level of the centering disk comprising the hook.

The thread suction device is preferably aligned transversely to the axis of rotation of the bobbin tube.

At least part of the application lever is preferably located on the same plane as the traversing thread guide, the suction device and the thread run between the traversing thread guide and the thread suction device, or it can be moved into this plane. It can be designed in such a way that it can push the thread directly or entrain it by means of a hook or a similar entrainment element and thus bring it into a thread clamping position.

The thread to be wound onto the bobbin tube can easily be severed from the previously fed thread if a thread cutter is provided on an outer side of the centering disk comprising the hook which faces away from the bobbin tube.

The centering disk comprising the hook preferably has an annular groove formed between the outer cone and a thread unwinding cone, on which the thread cutter can be provided.

Alternatively, the thread cutter can be arranged at another point, on the outer side of the centering disk comprising the hook facing away from the bobbin tube, through which a fixed thread passes when the centering disk continues to rotate after the thread has been caught.

The object is also achieved by a method for winding a thread on a winding machine onto a bobbin tube, which is tensioned by two opposing centering disks of a bobbin holder that are adjustable in their axial distance from one another, the centering disks each having a centering cone which engages in an open end of the bobbin tube, wherein the thread is caught with a fixed hook which is provided on at least one of the centering disks and aligned in the circumferential direction of this centering disk, in which the centering disk comprising the hook has an outer cone which overlaps the outer diameter of the bobbin tube end and the thread slides, when the bobbin tube is rotating, into at least one nose-shaped recess provided in the outer cone of the centering disk comprising the hook, which forms an inner side of the hook and is clamped on an edge formed between an inner wall of this outer cone and an edge between the outer side and the end face of the bobbin tube end.

The centering disks can be moved towards each other or towards the bobbin tube to clamp the bobbin tube and away from each other and away from the bobbin tube to release the bobbin tube.

The centering cone of the centering disk, which does not comprise the hook, holds and centers the clamped bobbin tube in that the centering cone dips into the open bobbin tube end and the edge between the end face and the inner side of the bobbin tube rests against the inclined outer wall of the centering cone.

The centering disks are preferably clamped in a chuck of the bobbin holder of the device according to the invention.

For the winding process, the thread is brought into a position in which it crosses the centering disk comprising the hook so that when the bobbin tube and the centering disks are rotating, the thread is entrained by the hook and guided into the thread clamping gap that begins directly behind the hook and ends at the thread clamping point.

In the method according to the invention, the thread clamping is simply released again by moving the centering disks away from each other and away from the bobbin tube.

In a preferred embodiment of the method according to the invention, the end of the bobbin tube is pressed against at least three annular segments formed in the inner wall of the outer cone of the centering disk comprising the hook and spaced apart by a groove when the bobbin tube is being tensioned, wherein one of these annular segments, on which the thread clamping point is formed, transitions directly into the recess, i.e., directly adjoins the hook.

The bobbin tube is held on the centering disk comprising the hook by the clamping force acting in the axial direction. The plurality of annular segments makes it possible for bobbin tubes with an outer and/or inner diameter, which is irregular as a result of the manufacturing process, to be accommodated by the centering disk comprising the hook and for the thread clamping point to be formed in a reliable manner.

It has proven to be particularly advantageous if, in an embodiment of the method according to the invention for clamping the thread, the thread is fed from a fixed feed position via a traversing thread guide located in the thread running direction in front of the bobbin tube to a cross-winding device of the bobbin tube running parallel to the axis of rotation of the bobbin tube, suctioned by means of a thread suction device located in the thread running direction behind the bobbin tube and aligned transversely to the axis of rotation of the bobbin tube, and, together with an application lever, brought into a thread clamping position in the running direction of the thread behind the bobbin tube, but before the thread suction device, in which the thread crosses the centering disk with the hook, wherein, in a plan view of the winding machine, a triangle is formed between the feed position of the traversing thread guide, the application lever and the thread suction device.

When the bobbin tube and the two centering disks are rotated, the thread brought into this position comes into contact with the hook and is guided by the latter into the thread clamping gap beginning behind the hook and fixed at the thread clamping point.

For this purpose, the bobbin tube is preferably accelerated to a rotational application speed which is advantageously greater than the feed speed of the thread. The fixed thread is wound onto the bobbin tube with a slight tensile force and pulled into the clamping gap. It is particularly advantageous if, during the first revolutions of the bobbin tube, the thread is wound onto a region for a thread reserve lying between a cross-winding device parallel to the axis of rotation of the bobbin tube and the centering disk comprising the hook.

The bobbin tube is decelerated after the thread has been applied and at the latest after the thread reserve has been wound to a winding speed, which preferably corresponds to the feed speed of the thread, or is slightly greater than said speed. The actual winding of the thread onto the bobbin tube takes place in the traversing region.

The thread can be severed particularly easily in a further development of the method according to the invention in that a region of the thread running in the thread running direction in front of the thread clamping point is wound around at least part of the circumference of the centering disk comprising the hook on an outer side of this centering disk facing away from the bobbin tube and is cut off by a thread cutter provided on this outer side of this centering disk.

In the present invention, the thread clamping point preferably opens automatically without the action of additional moving parts when a chuck of the device performs a releasing movement.

Preferred embodiments of the present invention, its design, function and advantages are explained in more detail below with reference to the figures.

BRIEF DESCRIPTION OF THE SEVERAL VIEWS OF THE DRAWING

FIG. 4 is a schematic depiction of one section each through plane A and plane B of FIG. 3 when the bobbin tube is clamped in;

DETAILED DESCRIPTION OF THE INVENTION

Figure 1:
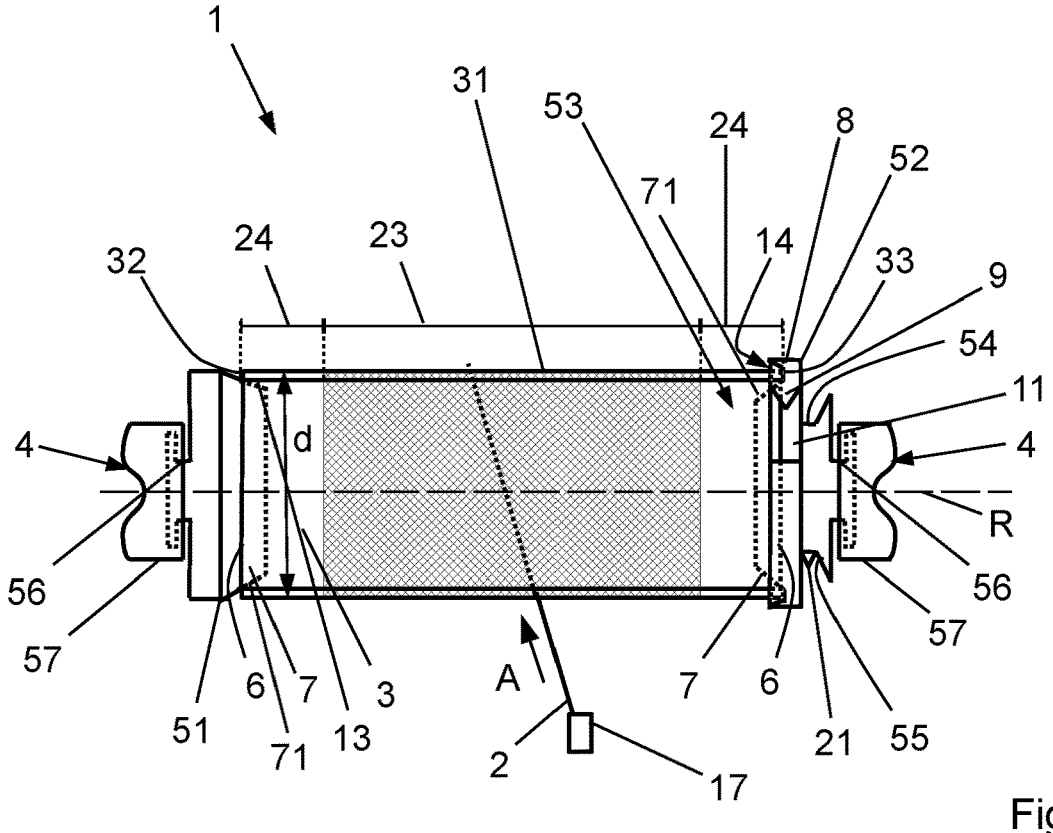
FIG. 1 is a schematic detail depiction of an embodiment of a device according to the invention in a side view while a thread is wound onto a bobbin tube of the device.

FIG. 1 is a schematic detail depiction of an embodiment of a device 1 according to the invention, on which a thread 2 is wound onto a bobbin tube 3 of the device 1. The device 1 is shown in FIG. 1 in a plan view of a front side of the bobbin tube 3 and includes further components, which are not shown here for the sake of clarity.

In the exemplary embodiment shown, the bobbin tube 3 is a cylindrical, internally hollow tube made of cardboard, but in other embodiments of the invention it can also be made of plastic or metal. The bobbin tube 3 has an outer side 31 and two opposite end faces 32, 33.

In the exemplary embodiment shown, the bobbin tube 3 does not have a thread-receiving slot or a thread-receiving groove on its outer side 31. The bobbin tube 3 can have manufacturing tolerances, such as, for example, no perfectly round cross section and/or uneven end face edges 32, 33.

The bobbin tube 3 is shown in FIG. 1 in a state clamped into the device 1. In this clamped state, the bobbin tube 3 is held tight by two opposing centering disks 51, 52 of a bobbin holder 4 of the device 1. The axis of rotation R of the bobbin tube 3, about which the bobbin tube 3 can be rotated on the device 1, is in a horizontal orientation.

The centering disks 51, 52 are adjustable in terms of their axial spacing from one another. That means that they can be moved towards each other and towards the bobbin tube 3 for tensioning the bobbin tube 3 and that they can be moved away from one another and away from the bobbin tube 3 to release the bobbin tube 3.

Each of the two centering disks 51, 52 has a centering cone 7, which is provided on a bobbin holding side 53 of the centering disks 51, 52 facing the bobbin tube 3, and comprises a disk clamping region 56 where the respective centering disk 51, 52 is clamped into a chuck 57 of a bobbin holder 4 of the device 1. The centering cone 7 comprises an inclined surface 71 in the radial outward direction. When the bobbin tube 3 is clamped into the device 1, this inclined surface 71 is at least partially immersed in the hollow interior of the bobbin tube 3 and thereby centers the bobbin tube 3.

In the centering disk 51, depicted on the left in the embodiment shown, the bobbin tube 3, when it is clamped to the device 1, rests on the inclined surface 71 with its edge or corner formed between the inner side 13 and the end face 32 of the bobbin tube 3.

In the embodiment shown, the centering disk 52 depicted on the right of the bobbin tube 3 is specially designed. This centering disk 52 comprises an outer cone 8, which is formed around the centering cone 7. A flat groove 78 is provided between the centering cone 7 and the outer cone 8, into which the inclined surface 71 of the centering cone 7 and an inner wall 12 of the outer cone 8 open so that a truncated cone is formed in the cross section.

Figure 3:
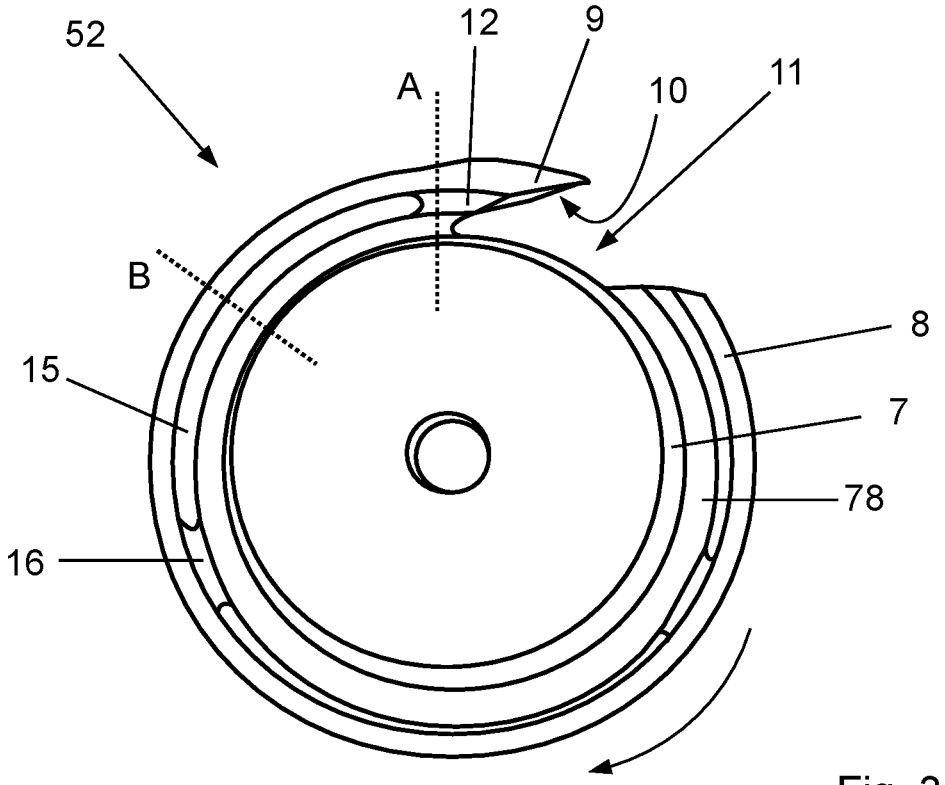
FIG. 3 is a schematic depiction of a centering disk of an embodiment of the device according to the invention comprising a hook in a perspective side view.

This centering disk 52 comprises a fixed hook 9 that is aligned in the circumferential direction of this centering disk 52. In this case, an inner side 10 of the hook 9 shown in FIG. 3 is formed by a nose-shaped recess 11 provided at least in the outer cone 8 of the centering disk 52.

Furthermore, the centering disk 52 comprising the hook 9 has an annular groove 54, which is formed between the outer cone 8 and an inlet bevel 55, on which a thread cutter 21 is provided. When the bobbin tube 3 is clamped, the annular groove 54 is further away from the bobbin tube 3 than the outer cone 8.

When the bobbin tube 3 is tensioned, the centering cone 7 of the centering disk 52 engages in an open bobbin tube end 6 of the bobbin tube 3, and the outer cone 8 of the centering disk 52 overlaps the outer diameter d of the bobbin tube end 6. The outer cone serves to pre-center the bobbin tube 3, while the centering cone 7 serves to tension and center the bobbin tube 3.

Behind the fixed hook 9, which is aligned in the circumferential direction of the centering disk 52, a thread clamping gap is formed, which opens into a thread clamping point 14. When the bobbin tube is clamped, the thread clamping point 14 is formed between the inner wall 12 of the outer cone 8 and the edge or corner having contact with the same between the outer side 31 and the end face 33 of the bobbin tube end 6.

The mode of operation of the hook 9 is described below in connection with FIG. 2; the design of the thread clamping point 14 is described below in connection with FIGS. 3 and 4.

To wind the thread 2, the thread 2 is fed from a fixed feed position to the bobbin tube 3 via a traversing thread guide 17. The traversing thread guide 17 moves back and forth between the two centering disks 51, 52 along a cross-winding device 23 running parallel to the axis of rotation R of the bobbin tube 3. The thread running direction A is indicated in the figures by an arrow on the thread 2. The thread 2 is thus wound onto the bobbin tube 3 in the region of the cross-winding device 23. The bobbin tube 3 rotates in a direction of rotation that points out of the image plane. The fed thread 2 thus initially has contact with the same at the bottom of the bobbin tube 3, then runs on the rear side of the bobbin tube 3 in the direction of the front side of the bobbin tube 3 etc. and is wound onto the bobbin tube 3 in this manner. Edge regions 24 of the bobbin tube 3 located between the cross-winding device 23 and the centering disks 51, 52 serve to wind up a thread reserve or remain free.

Figure 2:
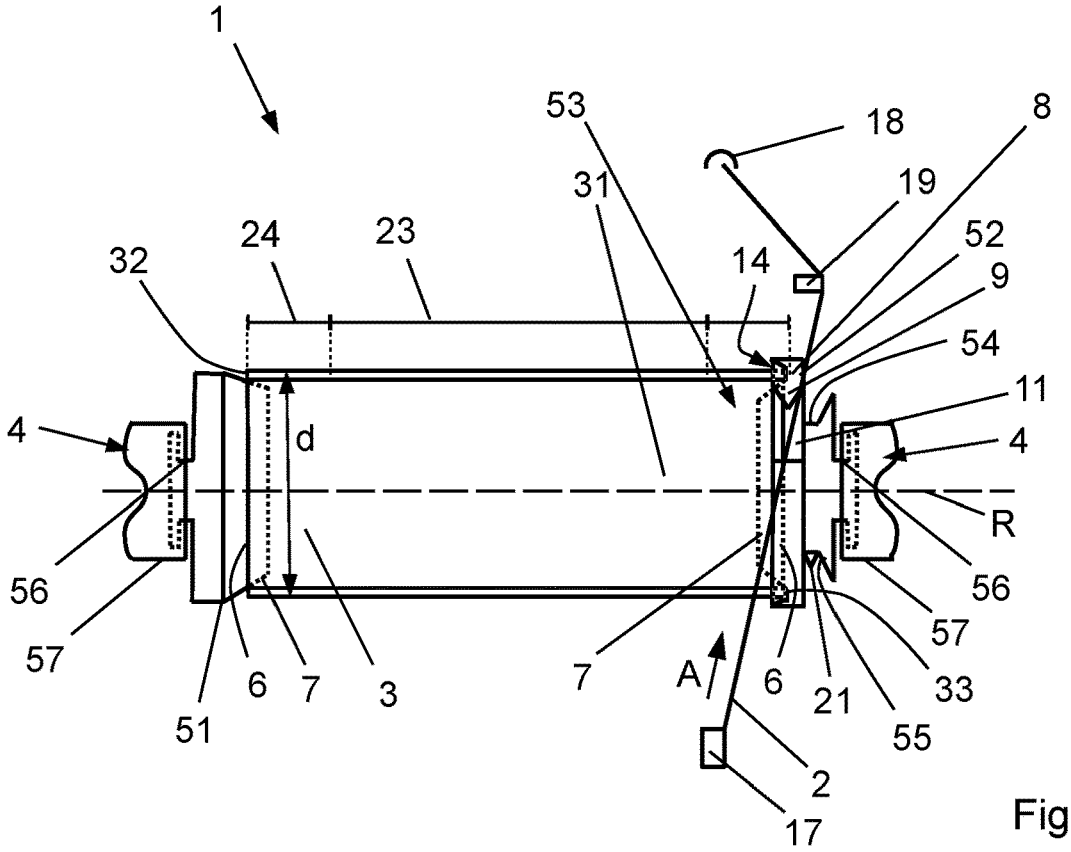
FIG. 2 is a schematic depiction of a step of an embodiment of the method according to the invention, in which a thread, which is to be wound onto a bobbin tube, shown here from below and clamped onto an embodiment of the device according to the invention, is suctioned by means of a thread suction device and brought into a thread clamping position by means of an application lever.

FIG. 2 is a schematic depiction of a step of an embodiment of the method according to the invention for winding a thread 2 onto an initially empty bobbin tube 3. FIG. 2 is a depiction of the bobbin tube 3 and the centering disks 51, 52 in a view of an underside of the bobbin tube 3.

In the process step shown in FIG. 2, the bobbin tube 3 shown in FIG. 1 was replaced by a new, empty bobbin tube 3, which is now to be wound with the thread 2 after the winding process has been completed. For this purpose, the thread 2 is brought into a thread clamping position in the method step of the method according to the invention shown in FIG. 2.

For this purpose, the device 1 comprises an at least horizontally movable application lever 19 and a thread suction device 18 located behind the bobbin tube 3.

In FIG. 2, the thread 2 fed from a fixed feed position via the traversing thread guide 17 is suctioned to the rear by means of the thread suction device 18. The thread suction device 18 is aligned transversely to the axis of rotation R of the bobbin tube 3. The empty bobbin tube 3 clamped between the centering disks 51, 52 is positioned between the traversing thread guide 17 and the thread suction device 18. It is first accelerated to a rotational application speed, which is preferably greater than the feed speed of the thread 2. The direction of rotation of the bobbin tube 3 and of the centering disks 51, 52 point out of the plane of the drawing, as also shown in FIG. 1.

In the method step shown in FIG. 2, the application lever 19 is located in the same plane as the traversing thread guide 17, the suction device 18 and the thread 2 running between them. The application lever 19 is arranged behind the bobbin tube 3 in the thread running direction A but before the thread suction device 18.

As a result of its movement running from left to right in FIG. 2, the application lever brings the thread 2 into a position in which the thread 2 crosses the centering disk 52 comprising the hook 9. In the longitudinal section shown schematically here from below onto the bobbin tube 3 and the centering disks 51, 52, a triangle is formed between the feed position of the traversing thread guide 17, the application lever 19 and the thread suction device 18.

As a result of the rotation of the centering disk 52 with the hook 9 around the axis of rotation R, the hook 9 inevitably grips the thread 2 and guides it into the thread clamping gap formed behind the hook 9 between the centering disk 52 and the bobbin tube 3, at the end of which there is the thread clamping point 14 on which the thread 2 is clamped.

Figure 7:
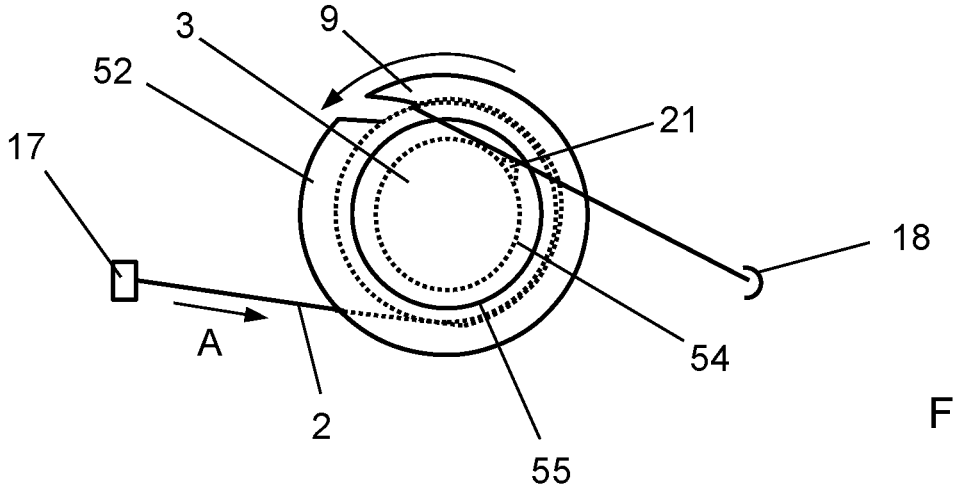
FIG. 7 is a schematic depiction of a step of this embodiment of the method according to the invention following the method step shown in FIG. 6, in which the clamped thread passes a thread cutter.

As can be seen in FIG. 7, as a result of the rotation of the centering disk 52, the clamped thread 2 is guided to a thread cutter 21 arranged on the annular groove 54 of the centering disk 52 and cut by said cutter.

The cut thread 2 remains clamped at the thread clamping point 14 when the bobbin tube 3 is clamped. The empty bobbin tube 3 clamped between the centering disks 51, 52 is brought to a winding rotational speed which is preferably lower than the rotational application speed and which corresponds to the feed speed of the thread 2 in the further course of the method according to the invention.

FIG. 3 is a schematic depiction of a centering disk 52 comprising a hook 9 of an embodiment of the device 1 according to the invention in a perspective side view of the side of the centering disk 52 pointing towards the bobbin tube 3. In FIGS. 1 and 2, this centering disk 52 is provided on the right of the bobbin tube 3.

The centering disk 52 comprises a centering cone 7 and an outer cone 8 inclined in the opposite direction to the inclination of the centering cone 7. On the outer cone 8, a fixed hook 9 aligned in the circumferential direction of the centering disk 52 is formed. The outer cone 8 also has a nose-shaped recess 11 which, in the embodiment shown, extends as far as the centering cone 7 and which, among other things, forms an inner side 10 of the hook 9.

In the embodiment shown, the inner wall 12 of the outer cone 8 comprises three annular segments 16, which are each spaced apart from one another by a groove 15. As an alternative, two or more than three annular segments 16 can also be present so as to ensure in each case a secure support of the bobbin tube 3. The embodiment showing three annular segments 16 provides the best possible support for bobbin tubes which, due to manufacturing processes, can have irregularities on their circumferential and/or inner wall. In other embodiments of the present invention, the inner wall 12 of the outer cone 8 can also be designed as a single annular segment, i.e., without the grooves described above. In principle, a groove can also be provided directly after the hook 9, in front of one of the annular segments 16.

A thread clamping point 14 is formed behind the hook 9 when the bobbin tube 3 is inserted.

Figure 4:
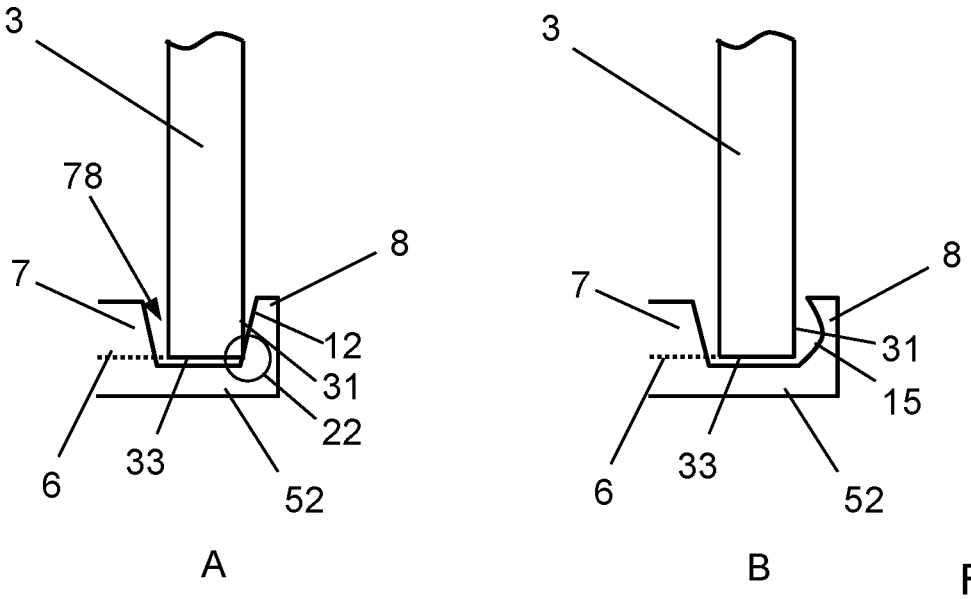

A section through the plane A and through the plane B of FIG. 3 with the bobbin tube 3 clamped in is shown in FIG. 4.

The centering cone 7 of the centering disk 52 engages in the open bobbin tube end 6 of the bobbin tube 3. The edge or corner between the end face 33 and the outer side 31 of the bobbin tube 3 rests against the inner wall 12 of the outer cone 8 on the centering disk 52.

The section A is located directly behind the hook 9 of the centering disk 52.

A thread clamping gap, the extent of which tends toward zero, is formed between the inner wall 12 of the outer cone 8 and an outer side 31 of the bobbin tube end 6 of the bobbin tube 3 placed on the centering disk 52. The thread 2 guided into this thread clamping gap is clamped at a thread clamping point 14. The thread clamping point 14 is formed at the edge or corner between the outer side 31 and the end face 33 of the bobbin tube end 6. This edge or corner can be angled, but it can also be indented.

The section B is located in the region of one of the grooves 15 in the inner wall 12 of the outer cone 8. The annular segments 16 spaced apart by means of the grooves 15 provide a multi-point support for the bobbin tube end 6, which ensures optimum support for the bobbin tube 3, whereby the centering disk 52 can accommodate irregularly shaped bobbin tube ends 6, which, for example, do not have a perfectly round cross-section. In each case, a suitable thread clamping point 14 is formed between the first annular segment 16 in the thread running direction A after the hook 9 and the edge or corner formed between the outer side 31 and the end face 33 of the bobbin tube end 6.

Figure 5:
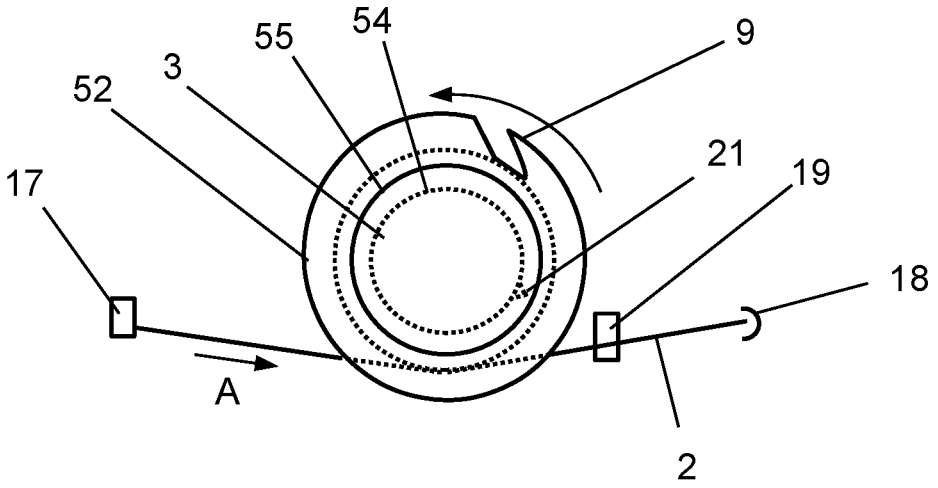
FIG. 5 is a schematic depiction of a step of an embodiment of the method according to the invention, in which the bobbin tube with the centering disk shown in a side view is brought onto the thread guided between the traversing thread guide and the thread suction device.
Figure 6:
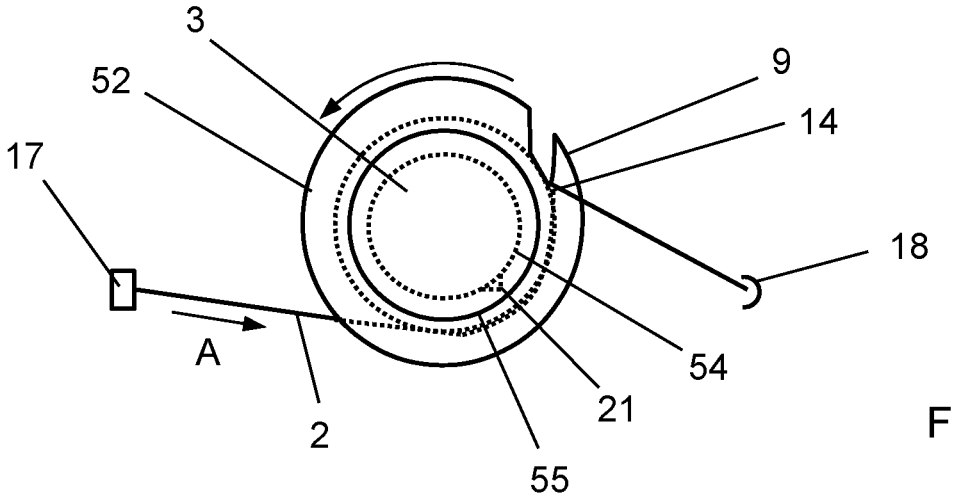
FIG. 6 is a schematic depiction of a step of this embodiment of the method according to the invention following the method step shown in FIG. 5, in which the thread was clamped in a thread clamping gap beginning behind the hook provided on the centering disk.

FIGS. 5 to 7 are a schematic depiction of three successive steps of an embodiment of the method according to the invention in which the bobbin tube 3 with the centering disk 52 comprising the hook 9 is shown in a side view.

The rotation of the bobbin tube 3 and the centering disk 52 is indicated in FIGS. 5 to 7 by an arrow on the centering disk 52.

In FIG. 5 is a schematic depiction of a step of an embodiment of the method according to the invention in which the bobbin tube 3 shown in a side view with the centering disk 52 comprising the hook 9 is brought onto the thread 2 running between the traversing thread guide 17 and the thread suction device 18.

The thread 2 fed via the traversing thread guide 17 from a fixed feed position is first suctioned to the rear via a thread suction device 18 and the empty bobbin tube 3 is positioned between the traversing thread guide 17 and the thread suction device 18. The thread 2 is initially not yet in contact with the centering disk 52.

The application lever 19, which is arranged in the thread running direction A between the bobbin tube 3 and the thread suction device 18, is movably supported parallel to the axis of rotation R of the bobbin tube 3. Both the axis of rotation R of the bobbin tube 3 and the direction of movement of the application lever 19 protrude into the plane of the drawing in FIGS. 5 to 7.

The application lever 19 is located behind the thread run of the thread 2 when looking at FIG. 5, so that, during a movement in a subsequent step of the embodiment of the method according to the invention shown, it moves the thread 2 from the plane of the drawing toward the observer in the direction of the centering disk 52 comprising the hook 9. As a result, the thread 2 arrives in a position in which it crosses the centering disk 52 comprising the hook 9.

FIG. 6 is a depiction of a step of this embodiment of the method according to the invention that follows the method step shown in FIG. 5, in which the thread 2 was captured by the hook 9 and guided into a thread clamping gap that begins behind the hook 9 and ends in the thread clamping point 14, where the thread 2 was finally clamped.

In the region between the thread clamping gap 14 and the traversing thread guide 17, part of the thread 2 runs along the circumference of the bobbin tube 3.

The clamped thread 2 is initially still suctioned by the thread suction device 18.

FIG. 7 shows the cutting of the clamped thread 2 in a step of this embodiment of the method according to the invention following the method step shown in FIG. 6.

An annular groove 54 and an inlet bevel 55 delimiting said groove are arranged on the outer side of the centering disk 52 facing away from the bobbin tube 3. A thread cutter 21 is located on the annular groove 54.

With the further rotation of the bobbin tube 3 and the centering disk 52, the clamped thread 2 inevitably comes into contact with the thread cutter 21 provided on the annular groove 54 and is severed by the same.

The severed thread 2 remains in the thread clamping gap 14, while the remainder of the thread 2 is suctioned off by the thread suction device 18.

The invention claimed is:

1. A device for winding a thread on a winding machine, the device comprising:

at least one bobbin tube having open bobbin tube ends formed therein, an outer side and an end face; and a bobbin holder having two opposing centering disks, adjustable in their axial distance from one another, for tensioning said at least one bobbin tube, wherein said centering disks each having a centering cone engaging in one of said open bobbin tube ends, wherein, on one of said centering disks, a fixed hook for catching the thread, being aligned in a circumferential direction of said one centering disk being formed, said one centering disk containing said fixed hook having an outer cone overlapping an outer diameter of a bobbin tube end of said bobbin tube ends, said fixed hook having an inner side with a nose-shaped recess formed therein and disposed at least in said outer cone, and when said at least one bobbin tube is clamped to the device an edge is applied between said outer side and said end face of said at least one bobbin tube end on an inner wall of said outer cone.

2. The device according to claim 1, wherein said inner wall of said outer cone is formed by at least three annular segments spaced apart from one another by one groove each, wherein one of said annular segments transitions directly into said nose-shaped recess.

3. The device according to claim 2, wherein said one annular segment which transitions directly into said nose-shaped recess, directly adjoins said fixed hook.

4. The device according to claim 1, further comprising:

a traversing thread guide disposed in a thread running direction in front of said at least one bobbin tube, parallel to an axis of rotation of said at least one bobbin tube and can be moved back and forth and stopped in a feed position;

a thread suction device disposed in the thread running direction behind said at least one bobbin tube and oriented transversely to the axis of rotation of said at least one bobbin tube; and an application lever being moved transversely to a thread run between said traversing thread guide and said thread suction device in a position disposed in the thread running direction behind said at least one bobbin tube at a level of said one centering disk having said fixed hook.

5. The device according to claim 1, further comprising a thread cutter disposed on an outer side of said one centering disk containing said fixed hook that faces away from said at least one bobbin tube.

6. A method for winding a thread on a winding machine onto a bobbin tube being tensioned by two opposing centering disks of a bobbin holder that are adjustable in their axial distance from one another, the centering disks each having a centering cone engaging in an open bobbin tube end of the bobbin tube, which comprises the steps of:

catching the thread with a fixed hook disposed on one of the centering disks and aligned in a circumferential direction of the one centering disk, the one centering disk containing the fixed hook having an outer cone overlapping an outer diameter of the bobbin tube end, and that the thread, when the bobbin tube rotates, slides into a nose-shaped recess provided at least in the outer cone, forming an inner side of the fixed hook, and the thread being clamped at a thread clamping point formed between an inner wall of the outer cone and an edge between an outer side and an end face of the bobbin tube end.

7. The method according to claim 6, wherein the bobbin tube end when tensioning the bobbin tube is pressed against at least three annular segments formed in the inner wall of the outer cone and spaced apart from one another by a groove, with one of the annular segments transitioning directly into the nose-shaped recess.

8. The method according to claim 6, wherein in order to clamp the thread, the thread is fed from a fixed feed position via a traversing thread guide disposed in a thread running direction in front of the bobbin tube to a cross-winding device of the bobbin tube running parallel to an axis of rotation of the bobbin tube, suctioned by means of a thread suction device disposed in the thread running direction behind the bobbin tube and aligned transversely to the axis of rotation of the bobbin tube, and, together with an application lever, brought into a thread clamping position in the thread running direction behind the bobbin tube, but before the thread suction device, in which the thread crosses the centering disk with the fixed hook, wherein, in a plan view of the winding machine, a triangle is formed between the fixed feed position of the traversing thread guide, the application lever and the thread suction device.

9. The method according to claim 6, wherein a region of the thread running in the thread running direction in front of the thread clamping point is wound around at least part of a circumference of the centering disk containing the fixed hook on an outer side of the centering disk facing away from the bobbin tube and is cut off by a thread cutter provided on an outer side of the centering disk.

10. The method according to claim 6, wherein the thread clamping point opens automatically without an action of additional moving parts when a chuck of the device performs a releasing movement.

* * * * *